US006813809B2

(12) United States Patent
Wörwag

(10) Patent No.: US 6,813,809 B2
(45) Date of Patent: Nov. 9, 2004

(54) VACUUM CLEANING TOOL WITH ROTATING BRUSH ROLLER

(75) Inventor: Peter Wörwag, Staad (CH)

(73) Assignee: Düpro AG, Romanshorn (CH)

( * ) Notice: Subject to any disclaimer, the term of this patent is extended or adjusted under 35 U.S.C. 154(b) by 316 days.

(21) Appl. No.: 10/087,254

(22) Filed: Mar. 1, 2002

(65) Prior Publication Data

US 2002/0120999 A1 Sep. 5, 2002

(30) Foreign Application Priority Data

Mar. 3, 2001 (DE) ..... 101 10 312

(51) Int. Cl.[7] ..... A47L 9/04
(52) U.S. Cl. ..... 15/387; 15/419
(58) Field of Search ..... 15/383, 387, 419

(56) References Cited

U.S. PATENT DOCUMENTS 5,950,275 A 9/1999 Wörwag ..... 15/387
6,571,424 B2 * 6/2003 Roschi et al. ..... 15/387

FOREIGN PATENT DOCUMENTS

DE 3414 862 11/1985
DE 41 08 900 11/1992
DE 42 29 030 3/1994
EP 0 338 780 10/1989

* cited by examiner

*Primary Examiner*—Theresa T. Snider
(74) *Attorney, Agent, or Firm*—Gudrun E. Huckett

(57) ABSTRACT

A vacuum cleaning tool of a vacuum cleaning device has a housing with a turbine chamber and a working chamber. The housing has a suction slot extending transversely in the vacuum cleaning tool. A suction airflow generated by the vacuum cleaning device enters the working chamber via the suction slot. First and second flow connections between the working and turbine chambers allow the suction airflow to enter the turbine chamber. An air turbine in the turbine chamber is rotatably driven by the suction airflow and drives a cleaning tool in the working chamber. The housing has an outlet opening allowing the suction airflow to exit the turbine chamber. The first and second flow connections are located on opposite sides of an imaginary plane defined by the axis of rotation of the air turbine and a center of the outlet opening. The cross-section of one of the flow connections is adjustable.

18 Claims, 3 Drawing Sheets

VACUUM CLEANING TOOL WITH ROTATING BRUSH ROLLER

BACKGROUND OF THE INVENTION

1. Field of the Invention

The invention relates to a vacuum cleaning tool for a vacuum cleaning device, comprising a housing with a turbine chamber in which an air turbine is arranged that is rotatably driven by a suction airflow of the vacuum cleaning device about an axis of rotation. The air turbine drives a cleaning tool that is rotatably supported in a working chamber of the housing, wherein the bottom plate of the housing has a suction slot extending transversely to the working direction of the vacuum cleaning tool. The suction airflow enters the working chamber via the suction slot. A flow connection is provided between the working chamber and the turbine chamber, and the suction airflow for driving the air turbine enters the turbine chamber via the flow connection. An outlet opening is provided allowing the suction airflow to exit the turbine chamber.

2. Description of the Related Art

Such a vacuum cleaning device is described in EP 0 338 780 A2. For adjusting the drive power, a slide is provided which guides the suction airflow completely or partially toward the air turbine. For lowering the drive power, the slide must be moved horizontally in order to guide a portion of the suction airflow past one axial end of the air turbine. The resulting configuration of the turbine chamber impairs an optimal adjustment of the drive for obtaining a maximum efficiency of the suction airflow. Even when the air turbine is loaded with the entire suction airflow, a satisfactory drive power cannot be obtained.

SUMMARY OF THE INVENTION

It is an object of the present invention to configure a vacuum cleaning tool of the aforementioned kind such that for a high power yield a powerful drive of the cleaning tool can be obtained even under unfavorable working conditions while, at the same time, a simple adjustability of the air turbine output is possible.

In accordance with the present invention, this is achieved in that a second flow connection is provided between the working chamber and the turbine chamber, in that the first flow connection is located on one side of an imaginary plane and the second flow connection on the other side of the imaginary plane, wherein the plane is defined by the axis of rotation of the air turbine and the center of the outlet opening, and wherein the cross-section of one of the flow connections is adjustable.

According to the invention, in addition to the first flow connection between the working chamber and the turbine chamber provided for the driving airflow, a second flow connection is provided between these two chambers so that the suction airflow entering the working chamber through the suction slot can be divided into two partial flows. This has the advantage that the entire power of the suction airflow is always available at the suction slot for enabling a high cleaning action.

Since the first flow connection is positioned on one side of the plane, extending through the axis of rotation of the air turbine and the center of the outlet opening, and the second flow connection is positioned on the opposite side of this plane, a braking effect of the partial airflow entering the turbine chamber via the second flow connection results. This partial flow of the suction airflow loads the annular vane arrangement of the air turbine counter to its rotational direction so that not only the volume of the driving suction airflow of the first flow connection is reduced but, moreover, the branched-off partial airflow is used for braking. Accordingly, already a small partial airflow can result in a significant rotational speed decrease with reduced power output. The cross-sectional surface area of the flow connection for the braking airflow can therefore be smaller than the flow connection of the driving airflow. In this way, an arrangement of the two windows of the flow connections atop one another is possible in the partition between the working chamber and the turbine chamber.

Preferably, the cross-section of the second flow connection is adjustable while the cross-section of the first flow connection cannot be changed and is fixed. The second flow connection comprises an adjustable closure which is formed as a slide, preferably as a rotary slide. In this way, the flow connection for the braking airflow can have the cross-section of a semi-circle and the closure can be configured as a full circle (circular) disk in which an inner, preferably semi-circular, cutout, matching the cross-section of the flow connection, is provided for the braking airflow.

The closure in the form of a disk can be manually adjusted for which purpose the circumferential edge of the disk projects with a portion thereof from the housing through a slot provided in the housing. Expediently, the circumferential edge of the disk is knurled.

DESCRIPTION OF THE PREFERRED EMBODIMENTS

Figure 1:
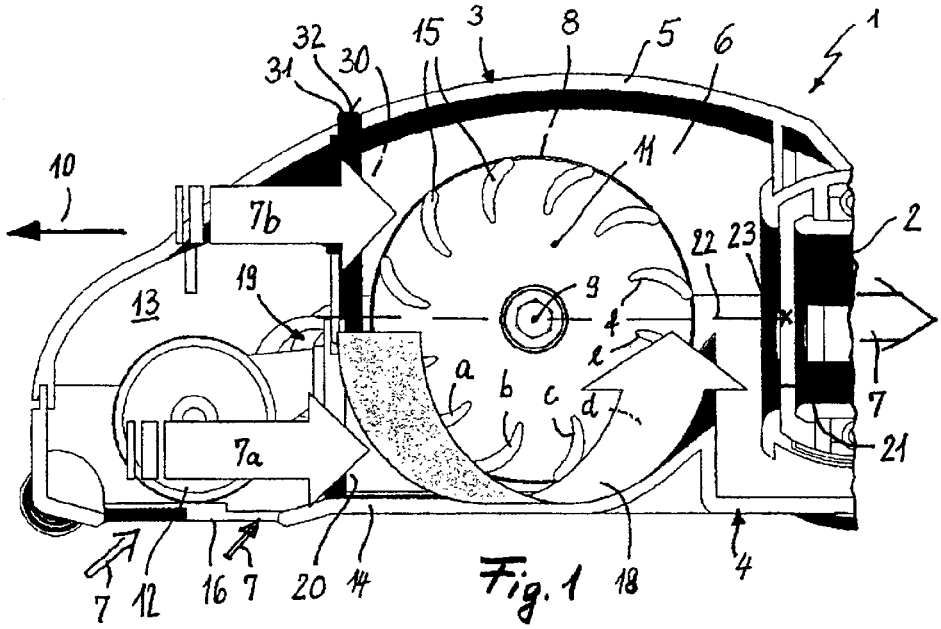
FIG. 1 is a schematic illustration of a partial section of the vacuum cleaning tool according to the invention.

The vacuum cleaning tool illustrated in the drawings is configured to be connected to a vacuum hose of a vacuum cleaning tool, not illustrated. The vacuum cleaning tool generates the suction airflow. The vacuum hose is connected to the connector socket 2 of the vacuum cleaning tool 1.

Figure 2:
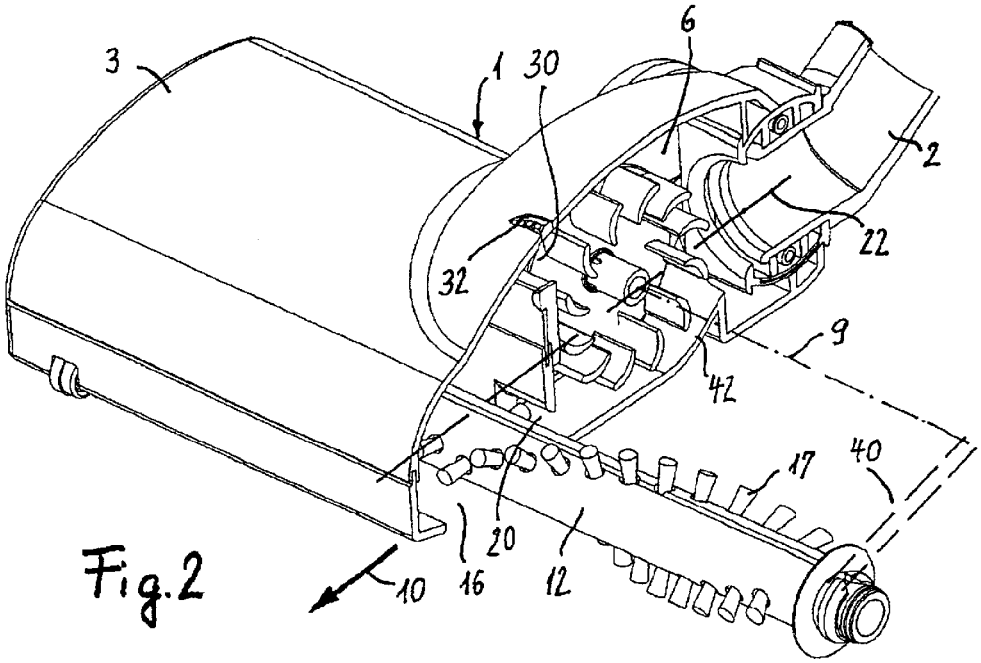
FIG. 2 is a perspective illustration of the vacuum cleaning tool according to the invention, partially in section.

The vacuum cleaning tool 1 is comprised of a housing 3 comprised of a lower housing half 4 and an upper housing half 5. A turbine chamber 6 is provided in the housing 3. The air turbine 8 driven by the suction airflow 7 is arranged in the turbine chamber 6. The air turbine 8 rotates about an axis of rotation 9 which, as to particularly illustrated in FIG. 2, extends transversely to the working direction 10 of the vacuum cleaning tool 1. The air turbine 8 has an annular vane arrangement with turbine vanes 15 which are arranged about the circumference of the turbine at identical spacing. In the illustrated embodiment, twelve such turbine vanes 15 are provided.

The inner ends of the turbine vanes 15 are positioned at a spacing to one another so that the airflow which drives the air turbine can pass between neighboring vanes 15 into the interior 11 of the air turbine 8. This provides an efficient use of the energy of the suction airflow.

The air turbine 8 drives a cleaning tool 12 which in the shown embodiment is a brush roller. The cleaning tool 12 is rotatably supported in a working chamber 13 of the housing 3. The working chamber 13 and the cleaning tool 12 extend substantially over the entire width of the housing 3 measured transverse to the working direction 10.

In the bottom plate 14 of the housing 3, i.e., within the lower housing half 4, a suction slot 16 is formed which enables entry of the suction airflow 7 into the working chamber 13. The suction slot 16 extends over the entire width of the housing 3 transversely to the working direction 10. The cleaning tool 12 is positioned above the suction slot 16 and acts with its outer periphery, for example, bristles 17, through the suction slot 16 onto the surface to be mechanically cleaned. The suction airflow 7 entering the working chamber 13 passes into the turbine chamber 6 via a first flow connection 20, positioned near the bottom plate 14 within the a partition 19 separating the working chamber 13 and the turbine chamber 6, and drives the air turbine 8 in the a direction of rotation 18. The suction airflow 7 exits from the turbine chamber 6 via an outlet opening 21 that is adjoined directly by the connector socket The position of the inlet opening of the first flow connection 20 relative to the outlet opening 21 is configured such that the partial airflow 7*a*, entering via the first flow connection 20, enters the interior 11 of the vane arrangement of the air turbine 8 at a first vane a and, in the rotational direction 18 of the air turbine, exits in an area defined approximately between the fourth vane d and the sixth vane f. Preferably, the suction airflow that has entered the interior 11 exits the interior 11 in the area of the fifth vane e, which trails the entry vane a in the rotational direction 18, and then flows into the outlet opening 21. With this arrangement, a high power output of the air turbine 8 with minimal power fluctuations and low noise can be obtained.

Between the working chamber 13 and the turbine chamber 6 a second flow connection 30 is provided which is positioned in the vicinity of the cover of the housing 3 and through which a partial airflow 7*b* enters the turbine chamber 6. The first flow connection 20 is positioned on a side of the plane 22 which is determined by the axis of rotation 9 of the air turbine 8 and the center 23 of the outlet opening 21. The second flow connection 30 is positioned on the opposite side of the plane 22 so that the two flow connections 20 and 30 are arranged in the partition 19 on opposite sides of the plane 22. The plane 22 can also be the dividing plane between the housing halves 4, 5.

The flow connections 20 and 30 include windows provided within the partition 19 and particularly arranged above one another, wherein the first flow connection 20 is provided in the partition portion of the lower housing half 4 and the second flow connection 30 is formed in the partition portion of the upper housing half 5. As a result of the selected position of the flow connections 20 and 30 relative to the axis of rotation 9 of the turbine, the first partial airflow 7*a* drives the air turbine 8 in the rotational direction 18 while the partial airflow 7*b* entering through the second flow connection 30 loads the air turbine 8 counter to the rotational direction 18 by a braking action.

Figure 5:
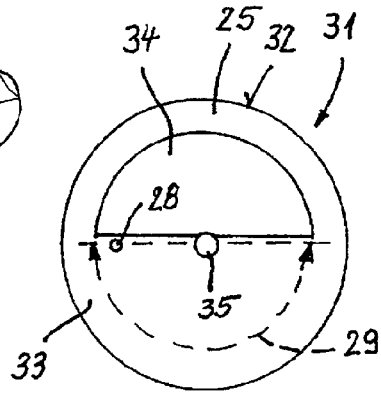
FIG. 5 is a view of a rotary slide.

For adjusting the desired power of the air turbine 8, it is proposed to design the cross-section of the flow connection 20, 32 to be adjustable. In the illustrated embodiment the cross-section of the second flow connection 30 is adjustable while the cross-section of the first flow connection 20 is fixed and cannot be changed. Preferably, in the window of the second flow connection 30 an adjustable closure 31 is arranged which is formed as a rotary slide. As illustrated in FIG. 5, the rotary slide is a full circle disc 33 with an inner cutout 34 which has approximately the configuration of the window of the second flow connection 30. In the embodiment illustrated in the drawings, the second flow connection 30 has a semi-circular cross-section which preferably approximately matches the size and configuration of the cutout 34 in the closure 31.

Figure 3:
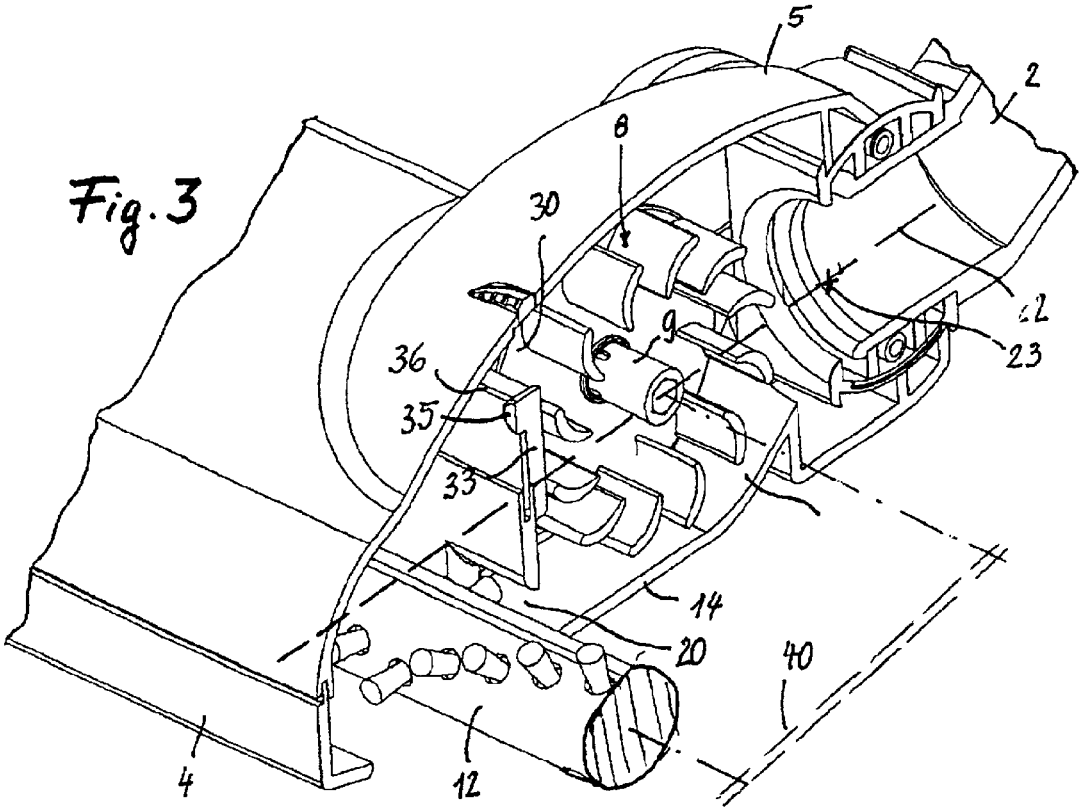
FIG. 3 is an enlarged illustration of a partial view of the perspective view of FIG. 2.
Figure 4:
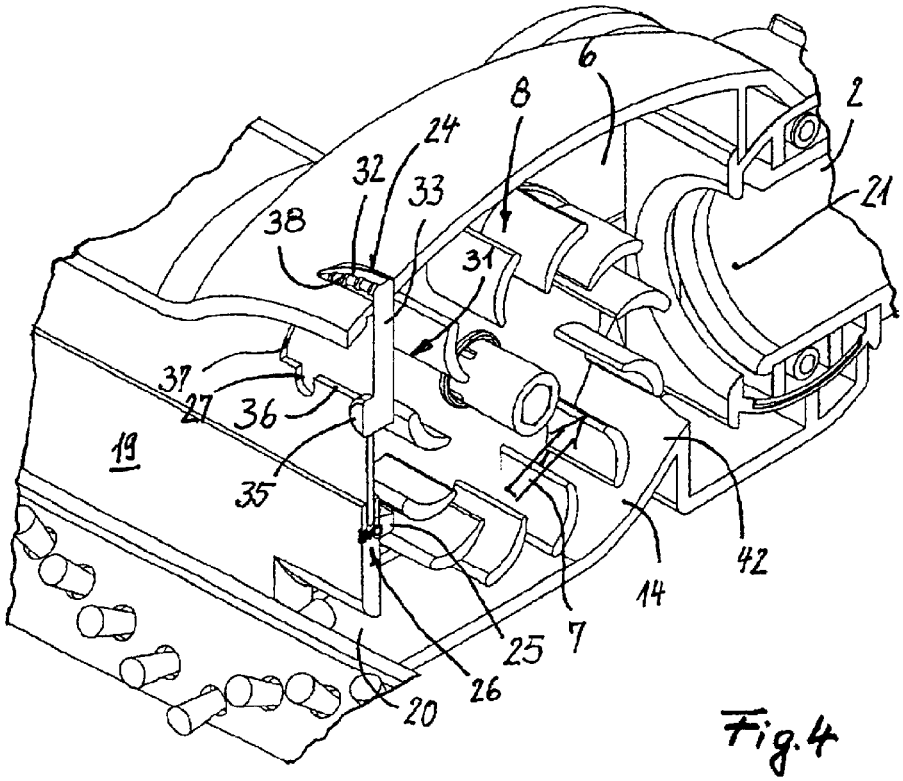
FIG. 4 is a perspective partial section of the illustration according to FIG. 3.

As illustrated in FIGS. 3 and 4, the disk 33 has a central hub 35 with which it is rotatably supported in the edge 36 of the window 37 of the second flow connection 30. For adjusting the closure 31, the circumferential edge 32 of the disk 33 projects from a slot 24 of the upper housing half 5 so that the user can rotate the disk 33 with his fingers. Expediently, the circumferential edge 32 is knurled (38) for this purpose.

The rotational range of the disk 33 or the closure 31 is limited to an angle 29 of approximately 180° by a rotational stop 28. The rotational stop 28 cooperates with cutouts 27 at the edge 36 of the window 37 of the second flow connection 30. In this connection, between the partition 19 and the disk 33 a catch device 26 can be expediently arranged which is, for example, comprised of a spring-loaded catch ball, a catch rib on the partition, or the like. The catch device 26 acts on the circumferential edge 32, in particular, on the knurled configuration 38 and ensures a rotational position of the closure 31 in several catch positions at a spacing of approximately 10° up to 60°. It may even be sufficient to configure the catch positions such that only the closed position, the semi-open position, and the open position of the closure 31 are secured.

Figure 6:
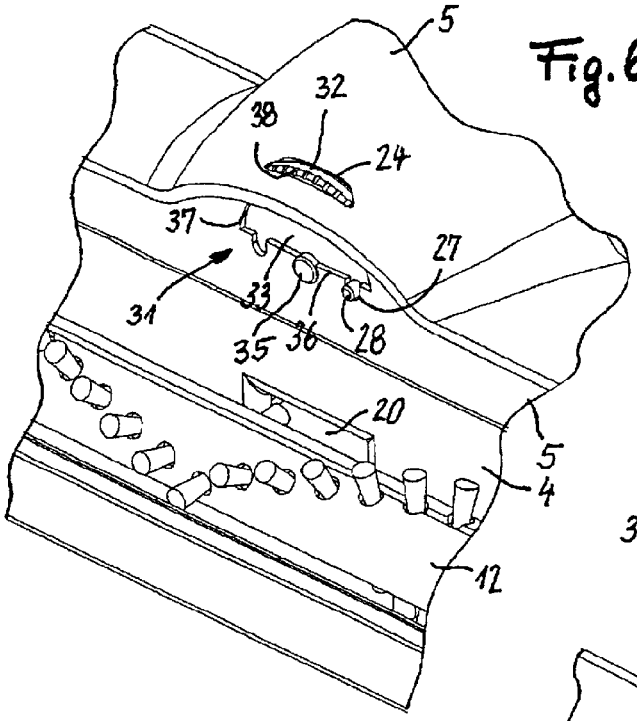
FIG. 6 is a partial section with closed second flow connection.

As illustrated in FIG. 4, when the closure 31 closes the flow connection 30, compare also FIG. 6, entry of the suction airflow is possible exclusively via the window of the first flow connection 20. The suction airflow 7 enters the turbine chamber 6 and the air turbine 8 and flows out via the outlet opening 21 and the connector socket 2. The catch device 26 acts on the stay 25 of the disk 33 limiting the cutout 34 and secures its rotational position. The air turbine 8 drives by means of a belt drive 40, not illustrated in detail, the cleaning tool 12 embodied as a brush roller in a powerful way. In this connection, the driving suction airflow 7 is guided by means of the ramp 42 provided on the bottom plate 14, so as to avoid unnecessary turbulence, approximately centrally to the outlet opening 21 which effects a high energy yield of the suction airflow 7.

In the completely closed position, the rotational stop 28 is positioned in a first cutout 27 of the edge 36 of the window 37. The knurled configuration 38 of the edge 32 can be easily gripped. A portion of the circumferential edge 32 projects upwardly from the housing 3 through the slot 24 provided in the upper housing half 5.

Figure 7:
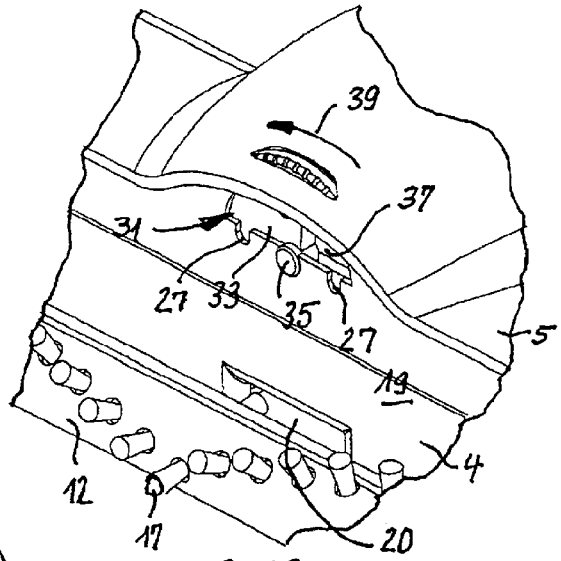
FIG. 7 is a partial section according to FIG. 6 with the flow connection being half open.

By rotating the closure 31 in the direction of arrow 39 (FIG. 7), the semicircular window 37 is opened halfway. The opening has thus the configuration of a quarter circle. In this position, as illustrated schematically in FIG. 1, the partial airflow 7*b* flows in via the second flow connection 30 and acts onto the air turbine 8 counter to the rotational direction 18. The drive power of the air turbine 8 decreases in accordance with the rotational position of the closure 31. The rotational speed of the air turbine 8 is lowered. The running noise of the air turbine also decreases.

Figure 8:
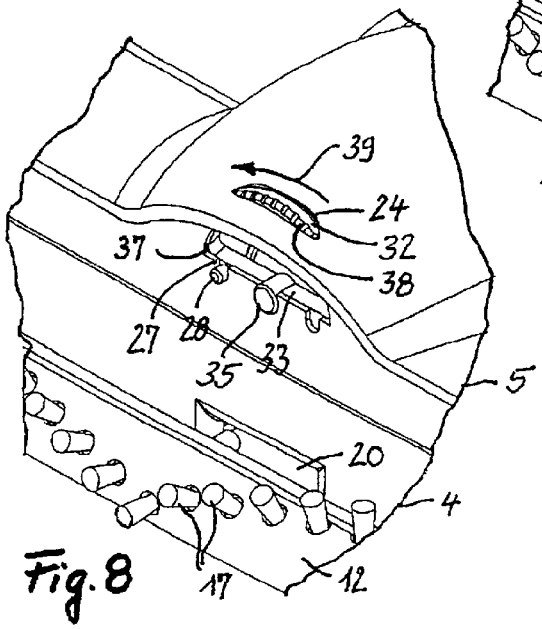
FIG. 8 is a partial section according to FIG. 6 with completely open flow connection.

In the completely open position of the rotary slide 33, illustrated in FIG. 8, the rotational stop 28 is now positioned in the other cutout 27 at the edge of the window 37. The closure 31 is now rotated in the direction of arrow 39 about the entire adjusting angle 29 of 180°. The semi-circular flow connection 30 is completely open. Because of the stay 25, the closure 33 remains accessible to the user and can be gripped by the user from the exterior. The user, depending on the working conditions, can adjust the power of the turbine and its rotational speed depending on the working requirements. In this connection, the suction airflow 7 entering via the suction slot 16 remains unchanged with respect to its volume so that at any time a high vacuum power is available at the suction slot 16 and an excellent cleaning action is provided.

While specific embodiments of the invention have been shown and described in detail to illustrate the inventive principles, it will be understood that the invention may be embodied otherwise without departing from such principles.

What is claimed is:

1. A vacuum cleaning tool comprising:

a housing (3) having a turbine chamber (6) and a working chamber (13);

the housing (3) having a bottom plate (14) with a suction slot (16) extending transversely to a working direction (10) of the housing (3), wherein a suction airflow (7) generated by a vacuum cleaning device connected to the housing (3) enters the working chamber (13) via the suction slot (16);

a first flow connection (20) and a second flow connection (30) provided between the working chamber (13) and the turbine chamber (6) allowing the suction airflow (7) to enter the turbine chamber (6);

an air turbine (8) arranged in the turbine chamber (6) and rotatably driven about an axis of rotation (9) by the suction airflow (7);

a cleaning tool (12) rotatably supported in the working chamber (13) and driven by the air turbine (8);

the housing (3) having an outlet opening (21) allowing the suction airflow (7) to exit the turbine chamber (6);

wherein the first flow connection (20) is located on a first side of an imaginary plane (22) and the second flow connection (30) is located on a second side of the imaginary plane (22), wherein the imaginary plane (22)is defined by the axis of rotation (9) of the air turbine (8) and a center (23) of the outlet opening (21); and wherein a cross-section of one of the first and second flow connections (20, 30) is adjustable.

2. The vacuum cleaning tool according to claim 1, wherein the cross-section of the second flow connection (30) is adjustable.

3. The vacuum cleaning tool according to claim 2, wherein the cross-section of the first flow connection (20) is fixed.

4. The vacuum cleaning tool according to claim 1, wherein a first partial flow **(7*a*) of the suction airflow (7) entering via the first flow connection (20) drives the air turbine (8) and wherein a second partial flow (7*b*) of the suction airflow (7) entering via the second flow connection (30) brakes the air turbine (8)**.

5. The vacuum cleaning tool according to claim 1, wherein the housing (3) has a partition (19) separating the working chamber (13) and the turbine chamber (6) from one another, wherein the first and second flow connections (20, 30) are provided in the partition (19).

6. The vacuum cleaning tool according to claim 5, wherein the second flow connection (30) comprises an adjustable closure (31).

7. The vacuum cleaning tool according to claim 6, wherein the closure (31) is a slide.

8. The vacuum cleaning tool according to claim 6, wherein the closure (31) is a rotary slide (33).

9. The vacuum cleaning tool according to claim 6, wherein the cross-section of the second flow connection (30) is substantially semi-circular.

10. The vacuum cleaning tool according to claim 9, wherein the closure (31) is a circular disk (33) having an inner cutout (34).

11. The vacuum cleaning tool according to claim 10, wherein the inner cutout (34) is semi-circular.

12. The vacuum cleaning tool according to claim 10, wherein the second flow connection (30) comprises a window (37) in the partition (19) and the circular disk (33) has a rotational stop (28) interacting with an edge of the window (37).

13. The vacuum cleaning tool according to claim 10, wherein the circular disk (33) has a circumferential edge (32) projecting with a partial section thereof from the housing (3).

14. The vacuum cleaning tool according to claim 6, further comprising a catch device (26) interacting with the adjustable closure (31).

15. The vacuum cleaning tool according to claim 14, wherein the catch device (26) is arranged on the partition (19).

16. The vacuum cleaning tool according to claim 15, wherein the closure (31) has a circumferential edge (32) and wherein the catch device (26) acts on the circumferential edge (32).

17. The vacuum cleaning tool according to claim 16, wherein the circumferential edge (32) is knurled.

18. The vacuum cleaning tool according to claim 1, wherein the housing (3) is comprised of an upper housing half (5) and a lower housing half (4), wherein one of the first and second flow connections (20, 30) is arranged in the upper housing half (5) and the other one of the first and second flow connections (20, 30) is arranged in the lower housing half (4).

* * * * *